US010252090B2

(12) United States Patent
Campbell

(10) Patent No.: US 10,252,090 B2
(45) Date of Patent: Apr. 9, 2019

(54) HEAT SENSITIVE PROTECTIVE BARRIER AND A METHOD FOR ITS USE

(71) Applicant: David Landis Campbell, Harleysville, PA (US)

(72) Inventor: David Landis Campbell, Harleysville, PA (US)

( * ) Notice: Subject to any disclaimer, the term of this patent is extended or adjusted under 35 U.S.C. 154(b) by 0 days.

(21) Appl. No.: 13/964,968

(22) Filed: Aug. 12, 2013

(65) Prior Publication Data

US 2013/0327549 A1 Dec. 12, 2013

Related U.S. Application Data

(63) Continuation-in-part of application No. 12/616,817, filed on Nov. 12, 2009, now Pat. No. 8,505,252.

(60) Provisional application No. 61/243,886, filed on Sep. 18, 2009, provisional application No. 61/769,659, filed on Feb. 26, 2013.

(51) Int. Cl.

| | |
|---|---|
| ***E04D 1/34*** | (2006.01) |
| ***A62C 3/00*** | (2006.01) |
| ***E04B 9/30*** | (2006.01) |
| ***A62C 99/00*** | (2010.01) |
| ***E04G 21/30*** | (2006.01) |

(52) U.S. Cl.

CPC ..... *A62C 3/00* (2013.01); *A62C 99/009* (2013.01); *E04B 9/30* (2013.01); *E04B 9/303* (2013.01); *E04G 21/30* (2013.01); *Y10T 428/192* (2015.01)

(58) Field of Classification Search

CPC ... F16C 5/64; A62C 2/06; A62C 2/065; A62C 2/08; A62C 2/10; A62C 3/0257; A62C 3/0264; A62C 99/00; A62C 99/0009; E04H 9/14; E04F 2290/045

USPC ..... 52/232, 3, 5, DIG. 12; 428/57, 58

See application file for complete search history.

(56) References Cited

U.S. PATENT DOCUMENTS

| | | | | |
|---|---|---|---|---|
| 3,040,815 | A | 6/1962 | Pambello | |
| 3,486,563 | A | 12/1969 | Cholin et al. | |
| 3,654,996 | A | 4/1972 | Naglowsky | |
| 5,104,700 | A * | 4/1992 | Peterson | 428/34.5 |
| 5,173,344 | A * | 12/1992 | Hughes | 428/36.1 |
| 5,244,731 | A * | 9/1993 | Saito et al. | 428/372 |
| 5,490,566 | A | 2/1996 | Purser | |
| 5,619,824 | A | 4/1997 | Russell et al. | |
| 5,836,397 | A * | 11/1998 | Craig et al. | 169/5 |
| 6,136,423 | A | 10/2000 | Fitzpatrick | |
| 6,572,948 | B1 * | 6/2003 | Dykhoff | 428/76 |

(Continued)

FOREIGN PATENT DOCUMENTS

JP 58060013 * 4/1983

*Primary Examiner* — William V Gilbert

(74) *Attorney, Agent, or Firm* — Muskin & Farmer, LLC

(57) ABSTRACT

Protective barriers are commonly installed beneath ceilings when construction work is performed either on these ceilings or on the roofs located above them. These protective barriers can be comprised entirely of one material or of different materials connected by seams. Some or all of these materials can be designed to fail when subjected to temperatures above a certain temperature range causing melting or some other destructive process to occur to these materials. These failures can create access points from the ceiling through the protective barrier to areas below being protected by the barrier, which can allow water from a fire suppression system, typically located near the ceiling, to reach a fire located below the protective barrier.

19 Claims, 8 Drawing Sheets

(56) References Cited

U.S. PATENT DOCUMENTS

| | | | | |
|---|---|---|---|---|
| 7,385,480 | B2 | 6/2008 | Fitzpatrick | |
| 7,992,647 | B2 | 8/2011 | Cordani | |
| 8,535,461 | B1 * | 9/2013 | Godbehere | 156/71 |
| 2011/0067330 | A1 * | 3/2011 | Campbell | 52/232 |
| 2012/0128943 | A1 | 5/2012 | Wangbunyen et al. | |

* cited by examiner

HEAT SENSITIVE PROTECTIVE BARRIER AND A METHOD FOR ITS USE

CROSS REFERENCE TO RELATED APPLICATIONS

This application is a continuation-in-part of U.S. nonprovisional patent application Ser. No. 12/616,817 filed Nov. 12, 2009, which is incorporated by reference herein in its entirety, which claims benefit to U.S. provisional application No. 61/243,866 filed Sep. 18, 2009, which is also incorporated by reference herein in its entirety. This application also claims the benefit of U.S. provisional patent application No. 61/769,659 filed Feb. 26, 2013, which is incorporated by reference herein in its entirety.

FIELD OF THE INVENTION

The present device relates to protective barriers that are typically installed beneath ceilings during construction work being performed on the ceilings or roofs of buildings. Such a protective barrier can be comprised of sections connected by seams. These seams or any other part of such protective barriers can be designed to fail and create openings through these protective barriers when subjected to temperatures above a certain point or range.

BACKGROUND

Protective barriers, such as those described herein, can prevent dust, debris and moisture, among other things, from falling on floors, people equipment, etc. located below a ceiling or roof being repaired or constructed. In this way, a protective barrier can prevent added costs from damage or injury resulting from such falling material and can allow normal activities to continue below the ceiling or roof being repaired. These barriers are commonly constructed from polyethylene sheets or similar materials, which have proven to be durable, easy to work with and inexpensive. However, a problem can arise with this type or protective barrier when it is installed below a fire suppression sprinkler system, which is often required in order to meet performance expectations. This type of installation can impair the flow of water from the fire suppression sprinkler system to a fire located beneath the protective barrier, which can prevent or impair the proper functioning of the fire suppression sprinkler system.

What is needed is a protective barrier that can perform its primary function of protecting people and property from falling dust and debris, but also has the capacity to allow water from a fire suppression sprinkler system to gain access to a fire located below the barrier when the barrier is subjected to elevated temperatures above a certain range.

SUMMARY OF THE INVENTION

It is an aspect of the present device to provide a protective barrier, which can protect people and property from falling dust, debris and moisture, but also has the capacity to allow water from a fire suppression sprinkler system to gain access to a fire located below the protective barrier, when the barrier is subjected to elevated temperatures above a certain range.

The above aspects can be obtained by a protective barrier that comprises at least two sections of heat insensitive material and a at least one seam comprising a heat sensitive material attaching the at least two sections of heat insensitive material.

The above aspects can also be obtained by a protective barrier, comprising: at least two sections of heat insensitive material; and a plurality of seams comprising a heat sensitive material and a water soluble material connecting the at least two sections of heat insensitive material.

The above aspects can also be obtained by a method that comprises providing a protective barrier, comprising: at least two sections of heat insensitive material; at least one seam comprising a heat sensitive material connecting the at least two sections of heat insensitive material; and providing a fire suppression system comprising water and at least one sprinkler; and placing the protective barrier under the fire suppression system.

These together with other aspects and advantages of the present device and method, which will be subsequently apparent, reside in the details of its construction and operation as more fully hereinafter described and claimed.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
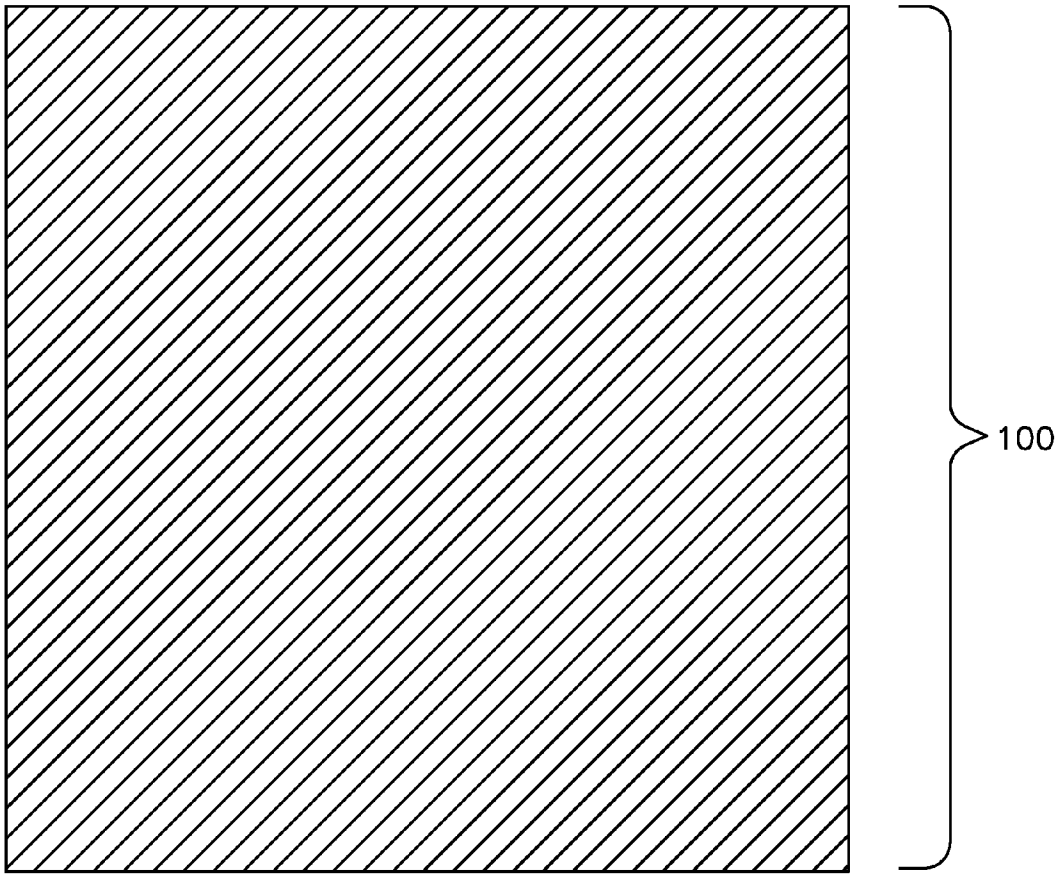
FIG. 1 is a schematic drawing of a protective barrier comprised entirely of a heat sensitive material according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

The properties of most materials change when subjected to various temperatures. For example, water melts at zero degrees (0°) Celsius and boils at zero degrees (100°) Celsius. Similarly, most solid materials disintegrate or lose tensile strength when heated beyond a particular temperature. Tensile strength is the amount of force required to pull a particular material apart. Thick sheets of polyethylene can have relatively high tensile strengths, which can remain high even when the polyethylene sheets are subjected to relatively high temperatures. As mentioned above a serious problem can arise when a protective barrier is located between a fire suppression system and a fire as the protective barrier can prevent water from the fire suppression system from reaching the fire. In such situations, the strength of the polyethylene sheets, or similar materials, which is a very desirable quality under normal circumstances, becomes a very undesirable quality as it can prevent a fire from being extinguished. A solution to this problem would be to construct all or part of the protective barrier, particularly its seams, from a more heat sensitive material than polyethylene or other materials commonly used to construct protective barriers. Specifically, this could be a material that would melt or disintegrate at lower temperatures, such as those that may be created by a fire located below the protective barrier. This melting and disintegration could allow openings to be created in the protective barrier and thus allow water to flow from a fire suppression system to the fire located below it.

FIG. 1 is a schematic drawing of a protective barrier 100 comprised of a heat sensitive material according to an embodiment.

A protective barrier 100 can be comprised entirely of a heat sensitive material, which can prevent dust and debris from reaching a protected area when exposed to temperatures below a certain point or range. This protective barrier can disintegrate in full or in part when subjected to temperatures above this point or range allowing water from a fire suppression sprinkler system (not shown in FIG. 1) to reach a fire or other heat source (also not shown in FIG. 1) located below the protective barrier 100. The protective barrier 100 can be comprised in total, or in part, of a polymer or other material known to one of ordinary skill in the art to melt, disintegrate or lose tensile strength when subjected to temperatures above the determined point or range.

Figure 2:
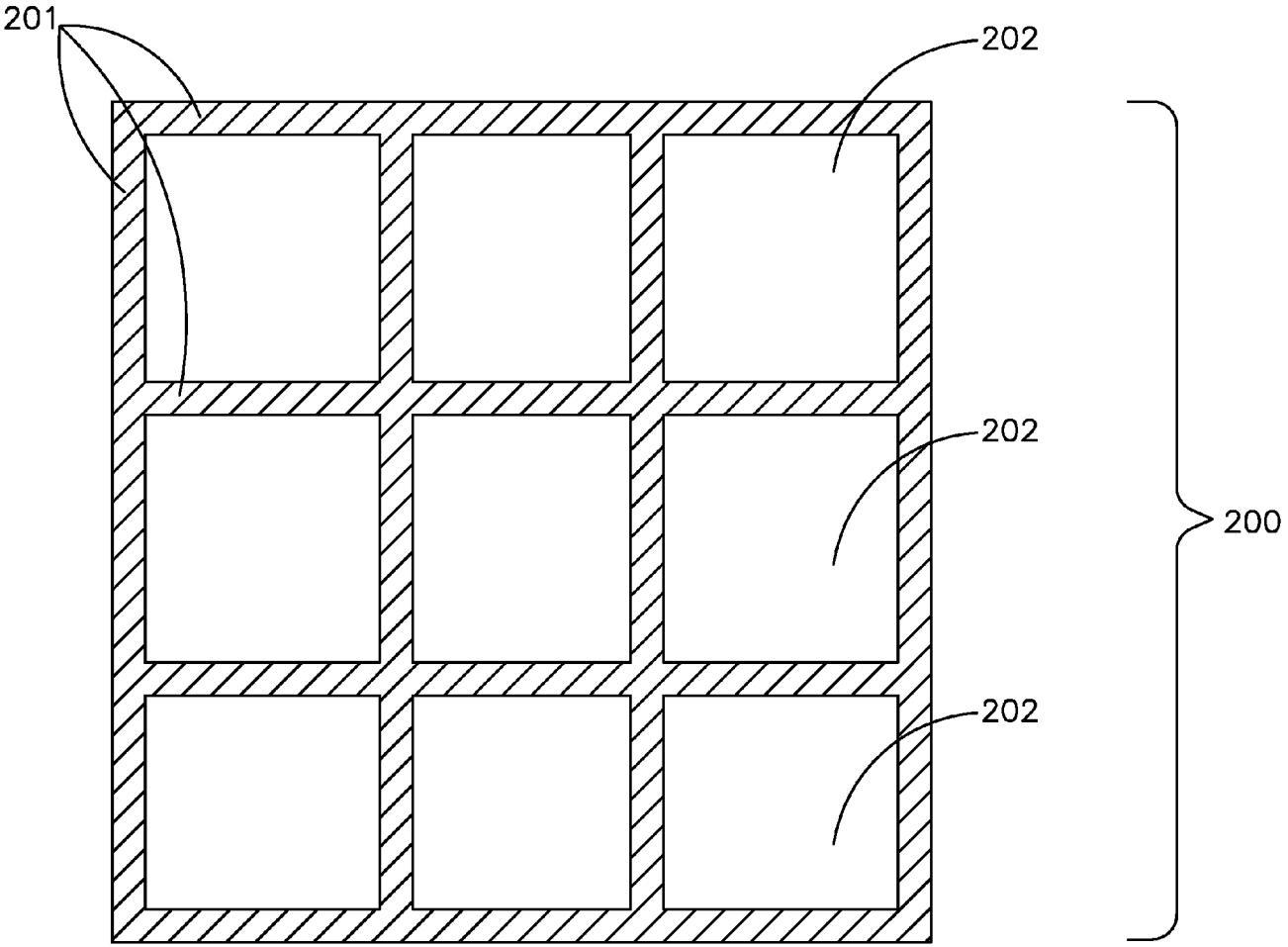
FIG. 2 is a schematic drawing of a protective barrier comprising heat sensitive seams, according to an embodiment.

FIG. 2 is a schematic drawing of a protective barrier 200 comprising multiple heat sensitive seams 201, according to an embodiment.

A protective barrier 200, comprising heat sensitive seams 201, can be comprised of sections 202 of standard, waterproof, water resistant, or dustproof material, such as polyethylene, vinyl or any other suitable material known to those with ordinary skill in the art of protective barriers. Seams 201 made from heat sensitive materials can connect these sections 202. Such seams 201 can also comprise strips of heat sensitive materials, which can be connected to the edges of the sections 202. These strips of heat sensitive material can be connected to the sections 202 by stitchings, adhesives, glues, rivets, staples, or any other similar suitable devices known to those with ordinary skill in the art (not pictured). Furthermore, the seams 201 can be totally comprised of heat sensitive stitchings, adhesives, glues, or similar suitable connecting devices known to those of ordinary skill in the art (not pictured) without the requirement of strips comprising heat sensitive material. Seams 201, comprising these heat sensitive materials, can melt, disintegrate or lose tensile strength when subjected to elevated temperatures allowing the sections 202 to fall to the floor or for openings to form between the sections 202 allowing water to pass by or through the protective barrier 200. In this way, the protective barrier 200 can allow water from a fire suppression system (not pictured) to reach a fire located below the barrier 200.

Figure 3:
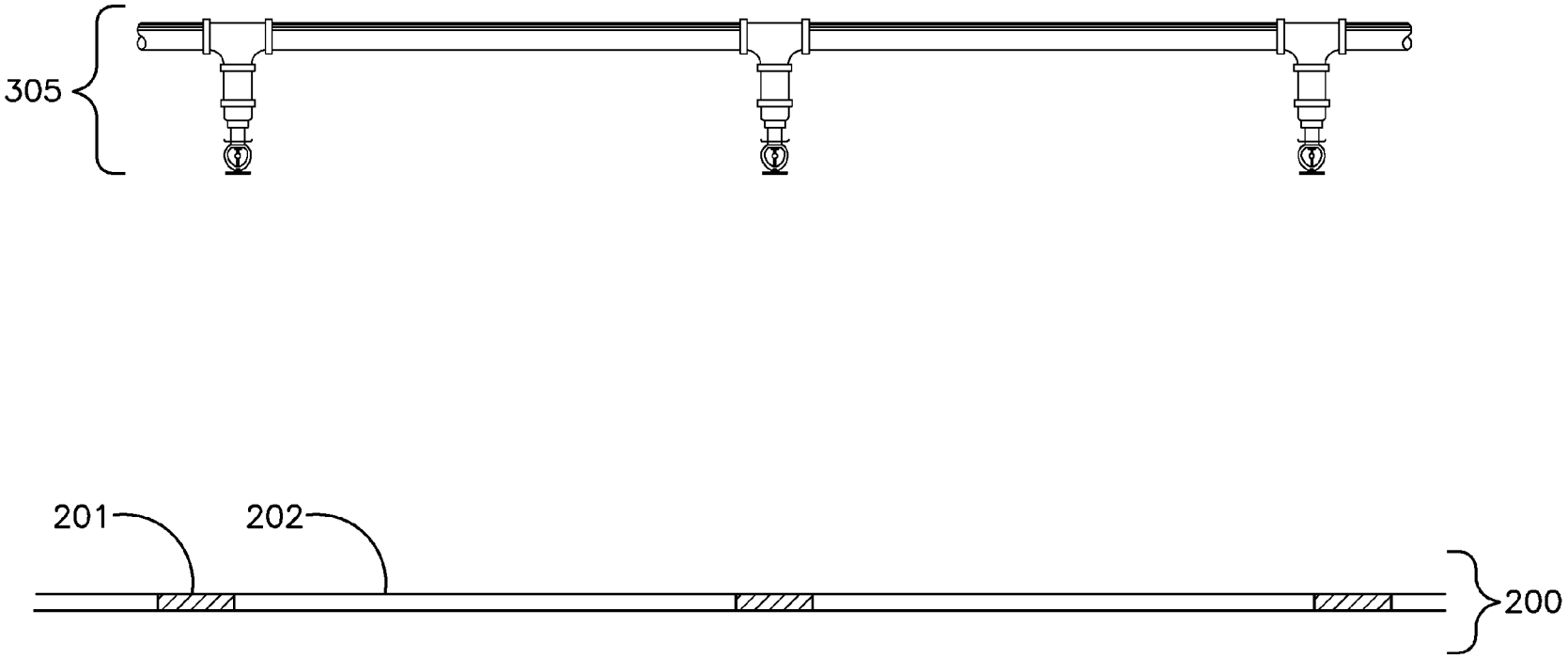
FIG. 3 is a side view of a protective barrier, such as that shown in FIG. 2, installed beneath a fire suppression system according to an embodiment.

FIG. 3 is a side view of a protective barrier 200, such as that shown in FIG. 2, installed beneath a fire suppression system 305 according to an embodiment.

The protective barrier 200 can be located below a fire suppression system 305 and above an area to be protected by the protective barrier 200. The protective barrier 200 can comprise sections 202 of standard, waterproof, water resistant or dustproof material, such as polyethylene, vinyl or other similar material known to those of ordinary skill in the art of protective barrier construction. These sections 202 can be connected by seams 201 made from heat sensitive materials, which can cause the sections 202 to separate when exposed to temperatures above a certain point or range. When not subjected to temperatures above this point or range, this protective barrier 200 can remain intact and prevent dust, debris and moisture from reaching the protected area located beneath it.

Figure 4:
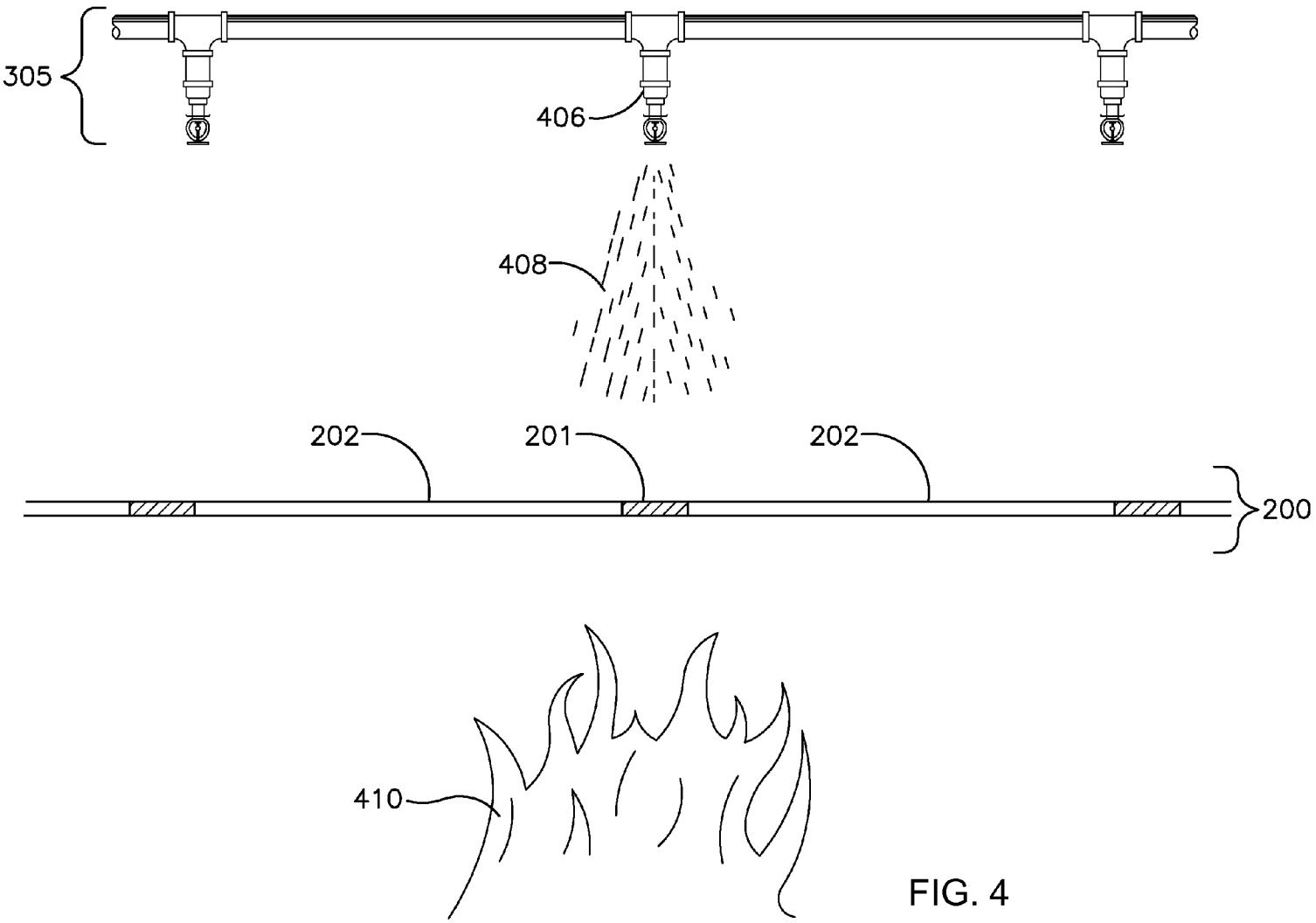
FIG. 4 is a side view of the protective barrier shown in FIG. 3, wherein a fire is located beneath the protective barrier and a sprinkler is located above the fire, according to an embodiment.

FIG. 4 is a side view of a protective barrier 200 installed beneath a fire suppression system 305, wherein a fire 410 is located beneath the protective barrier 200 and one or more sprinklers 406 are located above the fire 410, according to an embodiment.

In an embodiment, water 408 released by the sprinkler 406, which is part of the fire suppression system 305, would be prevented from reaching the fire 410 by the protective barrier 200 until one or more seams 201 connecting the two or more sections 202 are subjected temperatures above a determined point or range.

In an alternative embodiment, the entire protective barrier (not shown in FIG. 4, but shown in FIG. 1) can be comprised of one or more heat sensitive materials. When subjected to temperatures above a determined point or range, the protective barrier could be configured to partially or totally melt, disintegrate, tear or otherwise create openings (not shown in FIG. 5) in the protective barrier allowing water from the fire suppression system 505 to pass through such openings and reach the fire 510.

Figure 5:
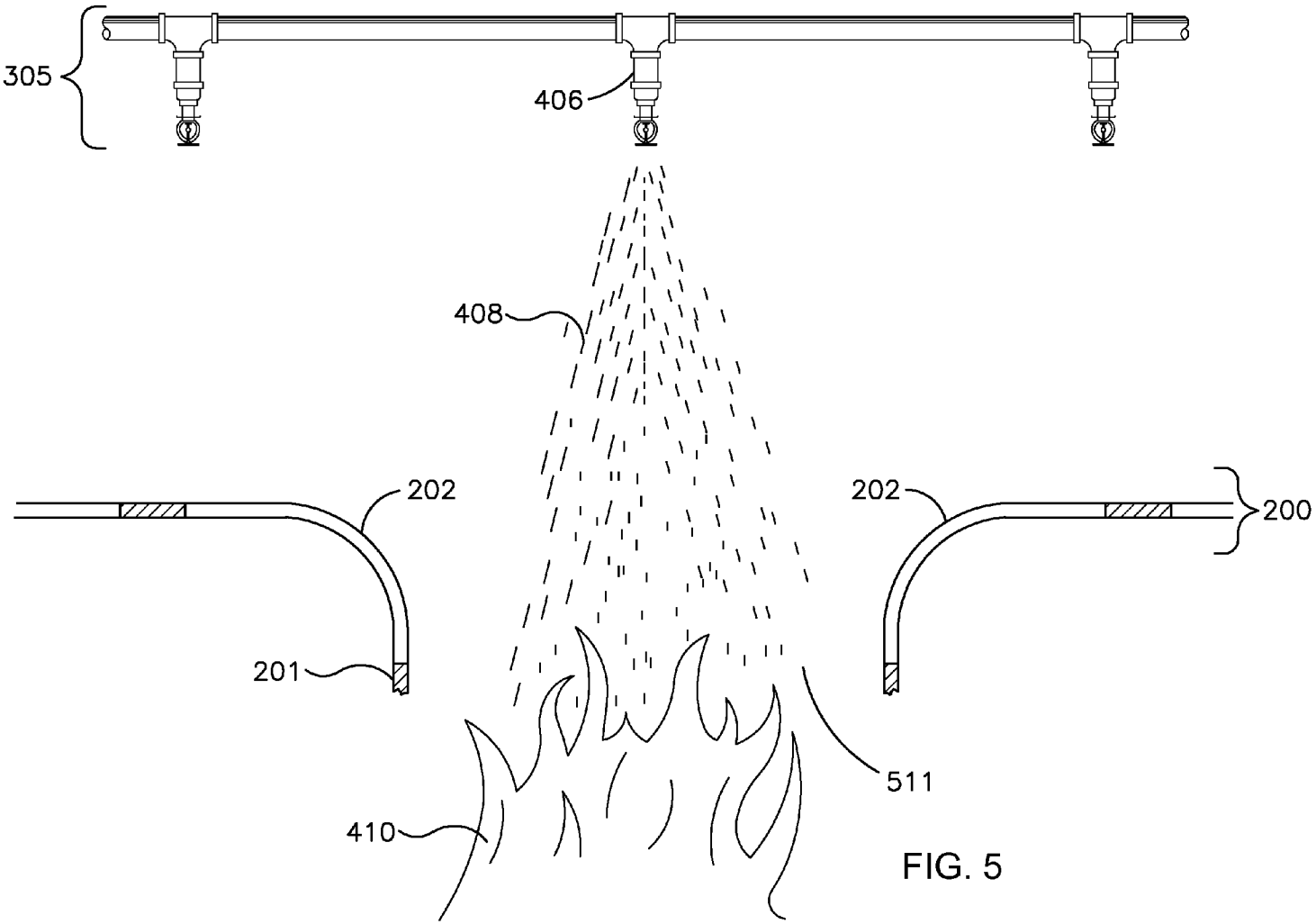
FIG. 5 is a side view of the protective barrier shown in FIGS. 3 and 4, wherein the protective barrier has been subjected to elevated temperatures created by the fire thus creating an opening in the protective barrier allowing water from a sprinkler to reach the fire, according to an embodiment.

FIG. 5 is a side view of a protective barrier 200 installed beneath a fire suppression system 305, wherein the protective barrier 200 has been subjected to temperatures above a determined point or range, which have been created by the fire 410 thus creating an opening 511 in the protective barrier 200 allowing water 408 from a sprinkler 406 to reach the fire 410, according to an embodiment.

The protective barrier 200 comprising temperature sensitive seams 201 can be comprised of sections 202 of standard, waterproof, water resistant or dustproof material, such as polyethylene, vinyl or other suitable material known to those of ordinary skill in the art of protective barriers. These sections 202 can be connected by temperature sensitive seams 201 constructed from materials that can allow the temperature sensitive seams 201 to fail at a temperature lower than the temperature set to activate the sprinklers 406.

This heat sensitive material can be a thread or similar structure comprising copolyamide, which is marketed under the trade name GRILON LT, or polycaprolacton, which is marketed under the trade name GRILON VLT 1 or any other material known to be sufficiently heat sensitive, or heat reactive so that the temperature sensitive seams 201, comprising these temperature reactive materials, can melt, open up, fall apart or otherwise disintegrate when the temperature sensitive seams 201, comprising the protective barrier 200 are heated to a certain temperature or range of temperatures. In an embodiment, these materials can have a temperature range, wherein disintegration, melting and loss of tensile strength occurs between temperatures of 50 degrees (50°) and one hundred fifty degrees (150°). This melting or disintegration can allow the sections 202 of the protective barrier 200 to either fall to the floor or form one or more openings 511 between the sections 202 allowing water 408 from a fire suppression sprinkler 406 to pass by or through the protective barrier 200.

In an embodiment, the temperature sensitive seams 201 can comprise a combination of water soluble seams and temperature sensitive seams wherein the water soluble seams can dissolve upon contact with water and the temperature sensitive seams can melt or disintegrate upon exposure to a certain temperature or range of temperatures. In an embodiment, this temperature or range of temperatures can be lower than the temperature required to activate a fire suppression sprinkler.

In another embodiment, the seams 201 can comprise temperature sensitive parts integrated together with water soluble parts. As with the seams that are comprised entirely of temperature sensitive materials, integrated temperature sensitive and water soluble seams can be configured to weaken and break when exposed to temperatures lower than the temperature set to activate the sprinkler, but higher than temperatures experienced under normal use conditions. The water soluble materials comprising such combined seams can dissolve upon contact with water. The weakening or disintegration of the temperature sensitive seams and the dissolving of the water soluble seams can allow the sections 202 of the protective barrier 200 to either fall to the floor to cause openings to form between the sections 202 allowing water from a sprinkler 406 to pass by or through the protective barrier 200. The water soluble materials can contain a polyvinyl alcohol, which is a species of chemicals used to create water soluble polymers.

The material(s) used to create temperature sensitive seams 201 in any of the embodiments described herein may cost more than the waterproof, water resistant, or dustproof materials comprising the heat insensitive sections 202. Thus, by combining the temperature sensitive seams 201 and the heat insensitive sections 202 as described herein, a more cost effective barrier can be produced. Furthermore, in addition to the square checkerboard pattern illustrated in FIG. 2, the heat insensitive sections 202 and temperature sensitive seams 201 can be formed and connected using other shapes and patterns as well, such as triangles, diamonds, polygons, curves, arbitrary shapes, etc.

In an embodiment, a protective barrier 100, such as that shown in FIG. 1, can be comprised entirely of temperature sensitive material, which can prevent dust, debris and moisture from reaching a protected area when heated to a particular temperature or temperature range. In an embodiment, this temperature can be within a range between 50 degrees (50°) and one hundred fifty degrees (150°) Celsius. Openings in this protective barrier 100 can form when any part is heated to temperatures within this range, which can be lower than the temperature set to activate a fire suppression sprinkler, allowing water from a sprinkler system, such as those shown in FIGS. 3, 4 and 5, to reach a fire, such as that shown in FIGS. 4 and 5, located below the protective barrier 100. The protective barrier 100 can be comprised of copolyamide, which is sometimes marketed under the trade name GRILON LT or polycaprolacton, which is sometimes marketed under the trade name GRILON VLT 1 or any other material known to be sufficiently heat sensitive so that the temperature reactive materials, can melt, open, fall apart or otherwise disintegrate when any part of the protective barrier 100 is heated to within a range between 50 degrees (50°) and one hundred fifty degrees (150°) Celsius.

Figure 6:
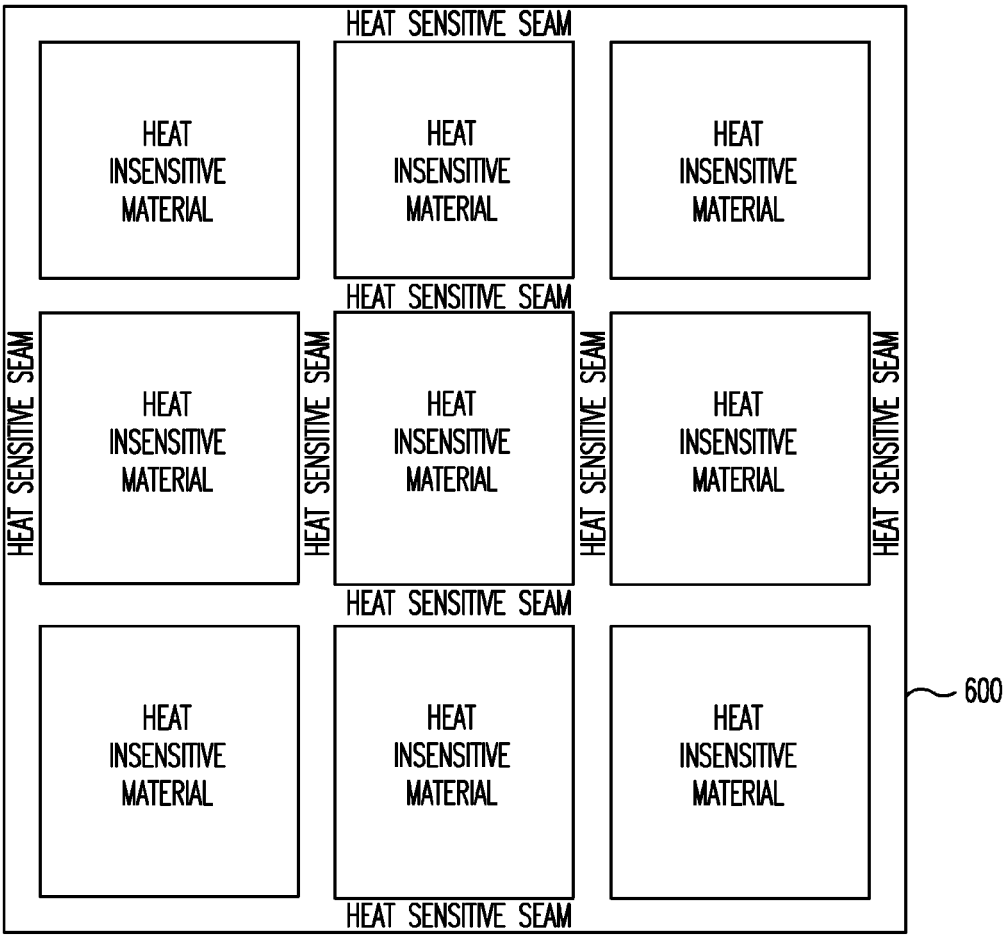
FIG. 6 is a schematic drawing of a protective barrier comprising labeled heat insensitive sections connected by labeled heat sensitive seams, according to an embodiment.

FIG. 6 is a labeled schematic drawing of a protective barrier 600 comprising sections of heat insensitive materials connected by heat sensitive seams, according to an embodiment.

Figure 7:
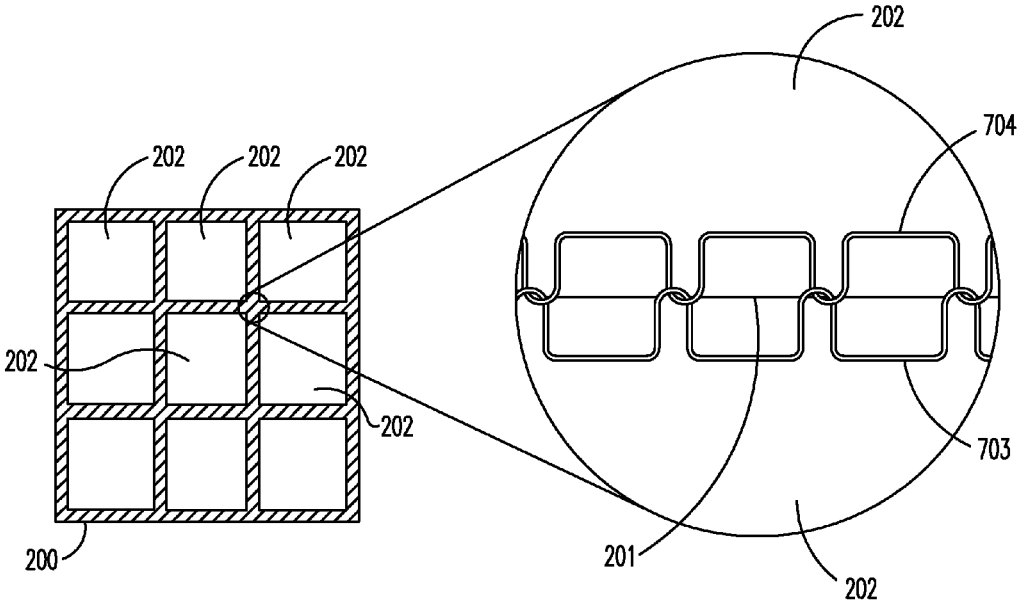
FIG. 7 is a close-up view of a heat sensitive seam, such as those shown in FIG. 2, wherein the seam is comprised of one or more heat sensitive threads, which can interlock to connect sections of the protective barrier which do not comprise heat sensitive materials, according to an embodiment.

FIG. 7 is a close-up view of a heat sensitive seam 201, such as those shown in FIG. 2, wherein the seam 201 can be comprised of one or more heat sensitive threads 703, which can interlock with heat insensitive threads 704 to connect sections 201 of the protective barrier 200, which do not comprise heat sensitive materials, according to an embodiment. These heat sensitive threads 703 can be comprised of a copolyamide, a polycaprolacton, or any other suitable heat sensitive material.

In an alternative embodiment, the heat insensitive threads 704 can be made from a water soluble material such as a polyvinyl alcohol thus creating a seam that can be designed to fail when either subjected to elevated temperatures or contacted by water. The seam depicted in FIG. 7 comprises an interlocking sewing pattern, which is designed to fail if either of the interwoven threads is broken. Therefore, if the seam shown in FIG. 7 comprised a heat sensitive thread 703 and a water soluble thread 704, such a seam would fail if it were either heated to a particular temperature or contacted by water.

Figure 8:
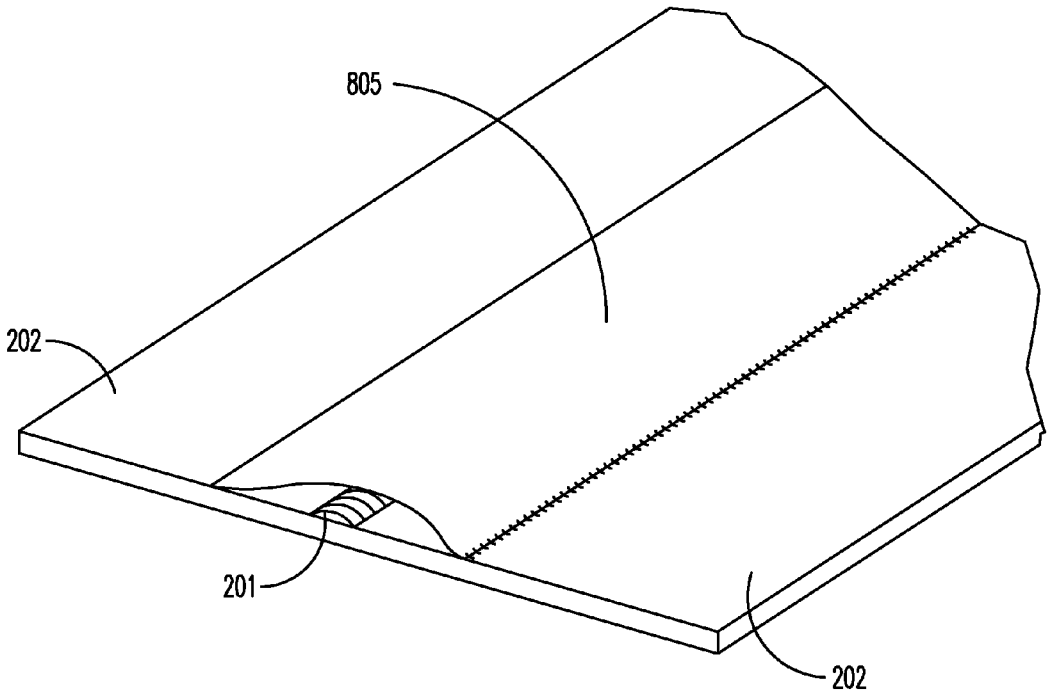
FIG. 8 is a perspective top and side view of a heat sensitive seam covered by a dust cap, according to an embodiment.

FIG. 8 is a perspective top and side view of a heat sensitive seam 201, such as that shown in FIG. 7, covered by a dust cap 805 according to an embodiment. In this embodiment, the dust cap can prevent dust or other material from accessing the seam, which can comprise small holes or other openings that may allow these materials to pass through the protective barrier. In an embodiment, this dust cap 805 can also be configured to fail when the seam 201 that it is covering fails.

Although the present inventive concept has been described in terms of exemplary embodiments, it is not limited thereto. Rather, the appended claims should be construed broadly, to include other variants and embodiments of the concept, which may be made by those skilled in the art without departing from its scope and range of equivalents.

What is claimed is:

1. A method for using a protective barrier, the method comprising:

providing a protective barrier, comprising:

at least two sections of heat insensitive material;

at least one seam comprising a heat sensitive thread that has a loss of tensile strength at temperatures between 50 degrees and 150 degrees Celsius, interlocked with at least one heat insensitive thread, connecting the at least two sections of heat insensitive material, wherein at least one seam comprising the heat sensitive thread fails when subjected to temperatures between 50 degrees and 150 degrees Celsius resulting in the two sections of heat insensitive materials becoming at least partially disconnected; and providing a fire suppression system comprising water and at least one sprinkler; and placing the protective barrier under the fire suppression system.

2. The method as recited in claim 1, wherein the sections of heat insensitive material are comprised of polyethylene.

3. The method as recited in claim 1, wherein the heat sensitive material is a copolyamide.

4. The method as recited in claim 1, wherein the heat sensitive material is a polycaprolactone.

5. The method as recited in claim 1, wherein the heat sensitive material is a glue.

6. The method as recited in claim 1, wherein the sections of heat insensitive material is comprised of a polymer.

7. A protective barrier, comprising:

at least two sections of heat insensitive material; and at least one seam comprising a heat sensitive thread that has a loss of tensile strength at temperatures between 50 degrees and 150 degrees Celsius, interlocked with at least one heat insensitive thread, which together connect the at least two sections of heat insensitive material, wherein at least one seam comprising the heat sensitive thread interlocked with at least one heat insensitive thread fails when subjected to temperatures between 50 degrees and 150 degrees Celsius resulting in the two sections of heat insensitive materials becoming at least partially disconnected.

8. The protective barrier as recited in claim 7, wherein the sections of heat insensitive material are comprised of polyethylene.

9. The protective barrier as recited in claim 7, wherein the heat sensitive thread is a copolyamide.

10. The protective barrier as recited in claim 7, wherein the heat sensitive thread is a polycaprolactone.

11. The protective barrier as recited in claim 7, wherein the sections of heat insensitive material is comprised of a polymer.

12. The protective barrier as recited in claim 7, wherein the at least one seam comprising a heat sensitive thread is located along at least one edge of a heat insensitive section.

13. A protective barrier, comprising:

at least two sections of heat insensitive material; and a plurality of seams comprising a heat sensitive thread that has a loss of tensile strength at temperatures between 50 degrees and 150 degrees Celsius, interlocked with at least one heat insensitive thread comprising a water soluble material connecting the at least two sections of heat insensitive material, wherein at least one seam comprising the heat sensitive thread fails when subjected to temperatures between 50 degrees and previously presented degrees Celsius resulting in the two sections of heat insensitive materials becoming at least partially disconnected.

14. The protective barrier as recited in claim 13, wherein the sections of heat insensitive material are comprised of polyethylene.

15. The protective barrier as recited in claim 13, wherein the heat sensitive material is a copolyamide.

16. The protective barrier as recited in claim 13, wherein the heat sensitive material is a polycaprolactone.

17. The protective barrier as recited in claim 13, wherein the heat sensitive material is a glue.

18. The protective barrier as recited in claim 13, wherein the sections of heat insensitive material is comprised of a polymer.

19. The protective barrier as recited in claim 13, wherein the water soluble material is a polyvinyl alcohol.

* * * * *